US005649441A

United States Patent [19]

Granholm et al.

[11] Patent Number: 5,649,441

[45] Date of Patent: Jul. 22, 1997

[54] ROLL-PAIR DRIVE ARRANGEMENT

[75] Inventors: Börje Granholm; Folke Leksén; Lennart Danielsson; Lars Tingvall, all of Smedjebacken, Sweden

[73] Assignee: Morgardshammar AB, Smedjebacken, Sweden

[21] Appl. No.: 525,516

[22] PCT Filed: Mar. 14, 1994

[86] PCT No.: PCT/SE94/00215

§ 371 Date: Sep. 12, 1995

§ 102(e) Date: Sep. 12, 1995

[87] PCT Pub. No.: WO94/21399

PCT Pub. Date: Sep. 29, 1994

[30] Foreign Application Priority Data

Mar. 15, 1993 [SE] Sweden ..... 9300850

[51] Int. Cl.[6] ..... B21B 35/00

[52] U.S. Cl. ..... 72/249

[58] Field of Search ..... 72/235, 237, 238, 72/249

[56] References Cited

U.S. PATENT DOCUMENTS 3,945,234 3/1976 Steinbock ..... 72/235

4,882,923 11/1989 Ichida et al. ..... 72/249

5,127,251 7/1992 Casegrande et al. ..... 72/239

FOREIGN PATENT DOCUMENTS 0 287 674 10/1988 European Pat. Off. .

*Primary Examiner*—Lowell A. Larson

*Assistant Examiner*—Thomas C. Schoeffler

*Attorney, Agent, or Firm*—Young & Thompson

[57] ABSTRACT

A roll-pair has synchronously driven shafts and a drive arrangement. The drive arrangement comprises an alternating current motor (12) and a planetary gear mechanism (13). The alternating current motor (12) and the planetary gear mechanism (13) are disposed in side-by-side relationship, the alternating current motor (12) having an output shaft and the planetary gear mechanism (13) having an input shaft. A transmission (14) connects the output shaft and the input shaft. The roll-pair and alternating current motor (12) and planetary gear mechanism (13) are all disposed on the same side of the transmission (14). The transmission (14) is a gear transmission. The input and output shafts are parallel to each other.

3 Claims, 6 Drawing Sheets

ROLL-PAIR DRIVE ARRANGEMENT

The present invention relates to a drive arrangement for roll-pairs with which the roll shafts are driven synchronously.

Present day roll-pair units included a rolling line of a rolling mill are comprised of separate parts which are connected to a supportive base structure and mutually coupled together to form a functional unit with the aid of coupling devices, which at times have the form of quick-fasteners which enable components to be separated quickly from one another to facilitate the exchange of mill components and maintenance. The drawback with this arrangement resides in the number of working procedures that must be carried out when changing a component, for instance when changing rolls. Another drawback resides in the amount of work that is required in installing and trimming such a roll-pair unit so that it can be integrated in the rolling line. These drawbacks are occasioned, among other things, by the fact that the roll-pair drive arrangement is often heavy, bulky and is comprised of many components. Some of these components will be different when the roll-pair unit is to be driven with the roll-pair shafts in a horizontal position instead of a vertical position. Furthermore, when switching from one rolled product to another rolled product, it is often sufficient to replace a roll-pair unit fitted with horizontal rolls in a rolling line with a similar roll-pair unit that is fitted with vertical rolls, and vice versa. There is therefore a need to construct the roll-pair units so that the rolls can be fitted both horizontally and vertically without needing to change the drive arrangement.

The object of the present invention is to eliminate the aforesaid drawbacks and to satisfy the aforesaid requirements.

According to the invention, this object is achieved with a drive arrangement of the kind defined in the introduction which is characterized in that it includes an alternating current motor and a planetary gear mechanism. This construction provides a lighter and more compact drive arrangement than drive arrangements that are constructed in accordance with the known techniques, and enables the drive arrangement to be constructed as a single manageable unit which can be placed both horizontally and vertically without needing to be changed.

According to one preferred embodiment of the invention, the alternating current motor is mounted on one side of the planetary gear mechanism and relative to the roll-pair on the same side of the planetary gear mechanism as a plane which passes through the ends of the output shaft of the alternating current motor and the input shaft of the planetary gear mechanism. The output shaft of the alternating current motor and the input shaft of the planetary gear mechanism are mutually connected by means of a transmission, preferably in the form of a gear transmission. The drive arrangement also includes a pinion stand and is constructed to form a single assembly unit which carries the roll unit containing the roll-pair.

The invention will now be described in more detail with reference to a preferred embodiment of the invention and also with reference to the accompanying drawings, in which FIG. 1 is a side view of a roll-pair unit provided with a drive arrangement according to one embodiment of the invention;

Figure 1:
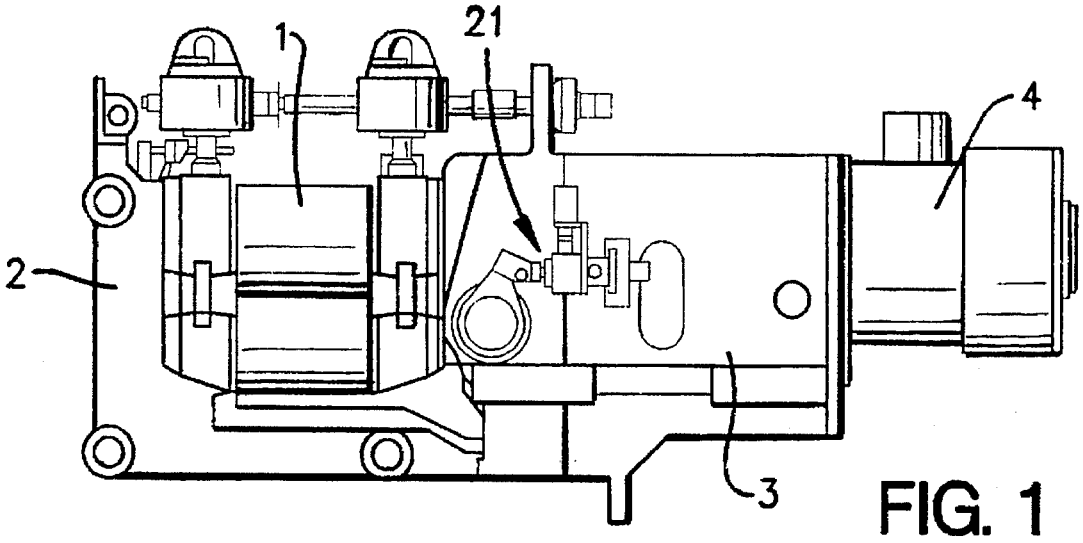

The illustrated exemplifying embodiment of a roll-pair unit includes a roll unit 1, a cassette 2, a pinion stand 3 and a drive unit 4. The roll unit 1 is carried by the cassette 2, which in turn is carried by the pinion stand housing 5, as is also the drive unit 4. Two spindles 6, 7 are journalled in the pinion stand housing and are in driving connection with the rolls 9, 10 through the medium of a coupling holder 8 fitted to the housing. The pinion stand housing also carries a roll hoist mechanism 11. Thus, the drive arrangement comprising the drive unit 4 and the pinion stand 3 has the form of a single assembly unit which also carries the cassette 2 which supports the roll unit.

The drive unit 4 includes an alternating current motor 12 and a planetary gear mechanism 13, wherein the motor and the gear mechanism are placed adjacent one another with the output shaft of the alternating current motor in the same plane as the input shaft of the planetary gear mechanism. These shafts extend parallel with one another and are mutually connected by means of a gear transmission 14. The planetary gear mechanism and the alternating current motor are both placed on that side of the gear transmission which lies proximal to the pinion stand housing.

By using a planetary gear mechanism and by placing this mechanism and the alternating current motor adjacent one another, there is obtained a roll-pair unit which occupies only a small amount of space laterally in relation to the rolling line, while the centre of gravity of the whole of the roll-pair unit will lie in the central region of the pinion stand housing 5, which is advantageous from an attachment or fastening point of view. In the case of the illustrated embodiment, the alternating current motor 12 is placed on one side of the planetary gear mechanism 13, although the construction which includes a gear transmission 14 which mutually connects the alternating current motor and the planetary gear mechanism enables the alternating current motor to be placed anywhere around the periphery of the planetary gearing, for instance above said planetary gearing. The alternating current motor is attached to the gear transmission housing, and the gear transmission is, in turn, attached to the planetary gear housing, which is attached to the pinion stand housing. However, because of its position on one side of the planetary gear mechanism, the alternating current motor may alternatively be carried directly by the pinion stand housing, if found desirable.

The alternating current motor may be a conventional motor with a power output of 300–800 kW and a speed of 1000–3600 r.p.m. Such a motor will weigh about 2 tonnes and will have a length of about 1.5 m and a diameter of about 0.8 m. The planetary gearing and the gear transmission together have a transmission ratio of between 85:1 and 8:1, a weight of 3.5 tonnes, a largest diameter of about 1 m and a length of about 1.7 m. The inventive drive arrangement is thus compact and manageable in comparison with earlier known roll-pair drive arrangements.

Figure 2:
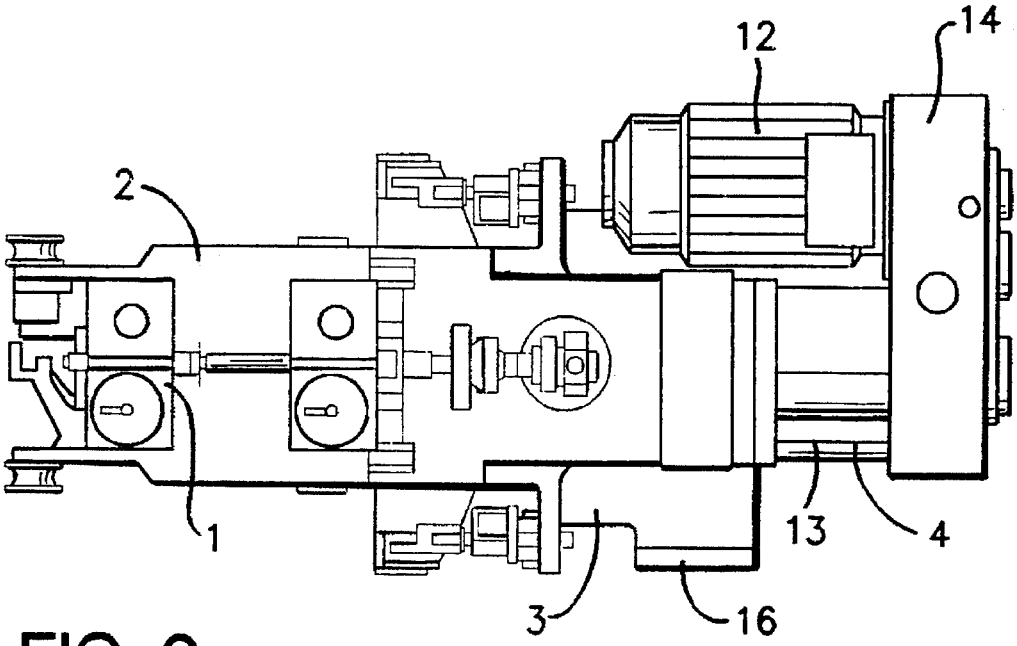
FIG. 2 shows the roll-pair unit in FIG. 1 from above.
Figure 3:
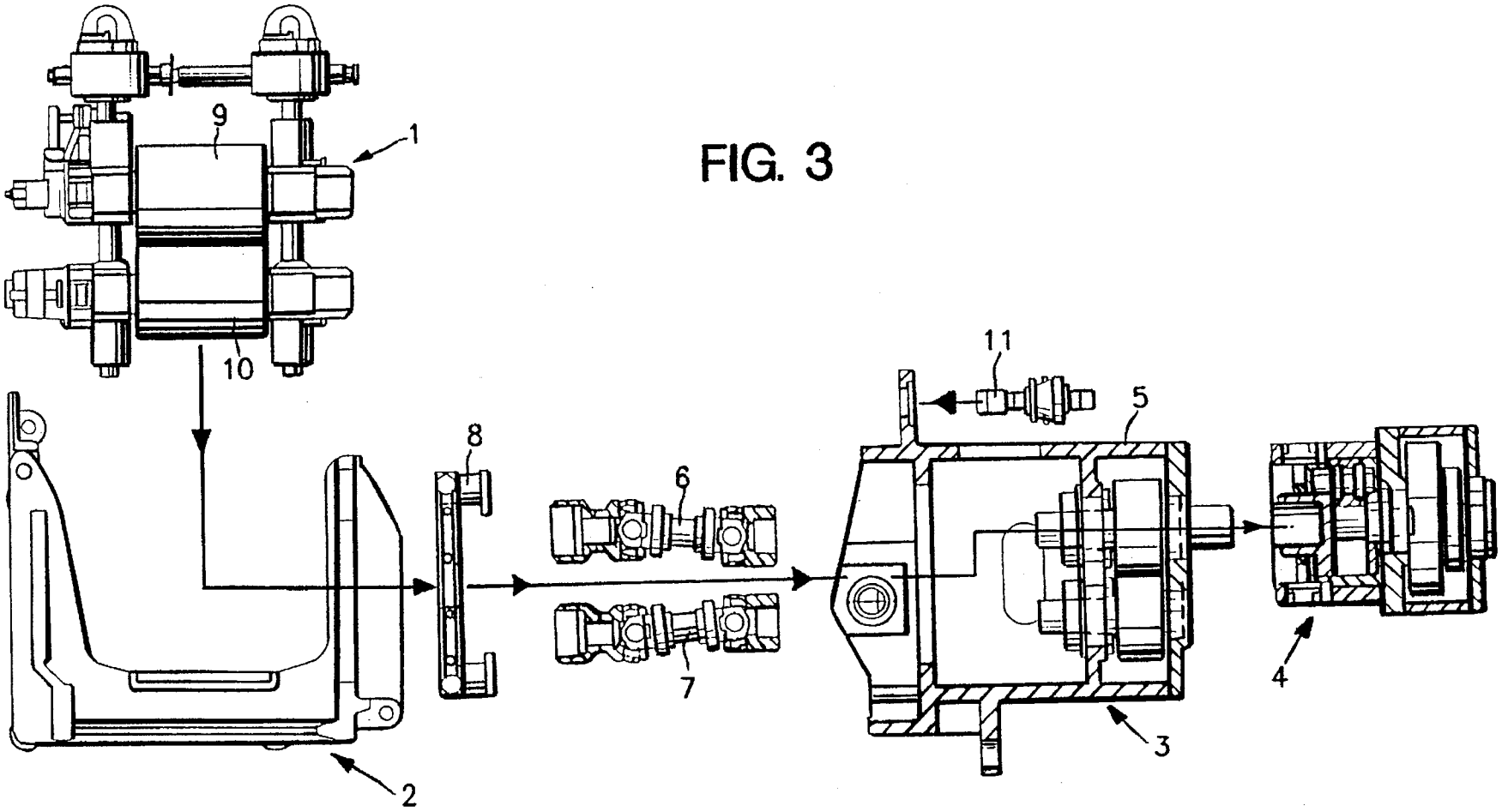
FIG. 3 is a sectional view of the roll-pair unit shown in FIG. 1 with the unit in a dismantled state.
Figure 4:
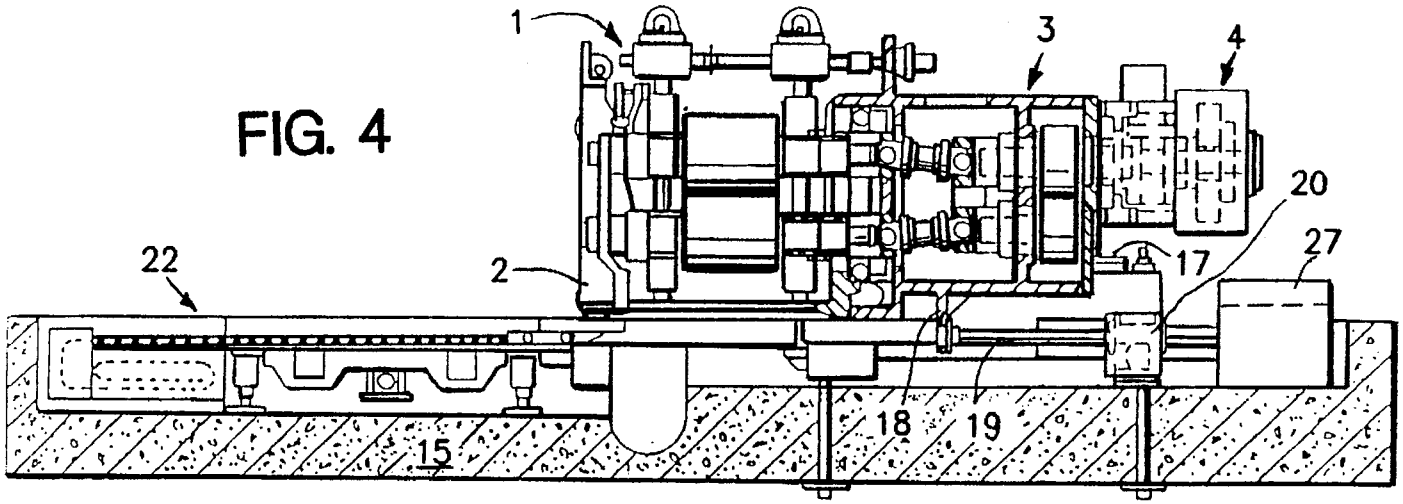
FIGS. 4 and 5 are respective vertical and horizontal sectional views of a roll-pair unit according to FIG. 1 in which the rolls are arranged horizontally.
Figure 5:
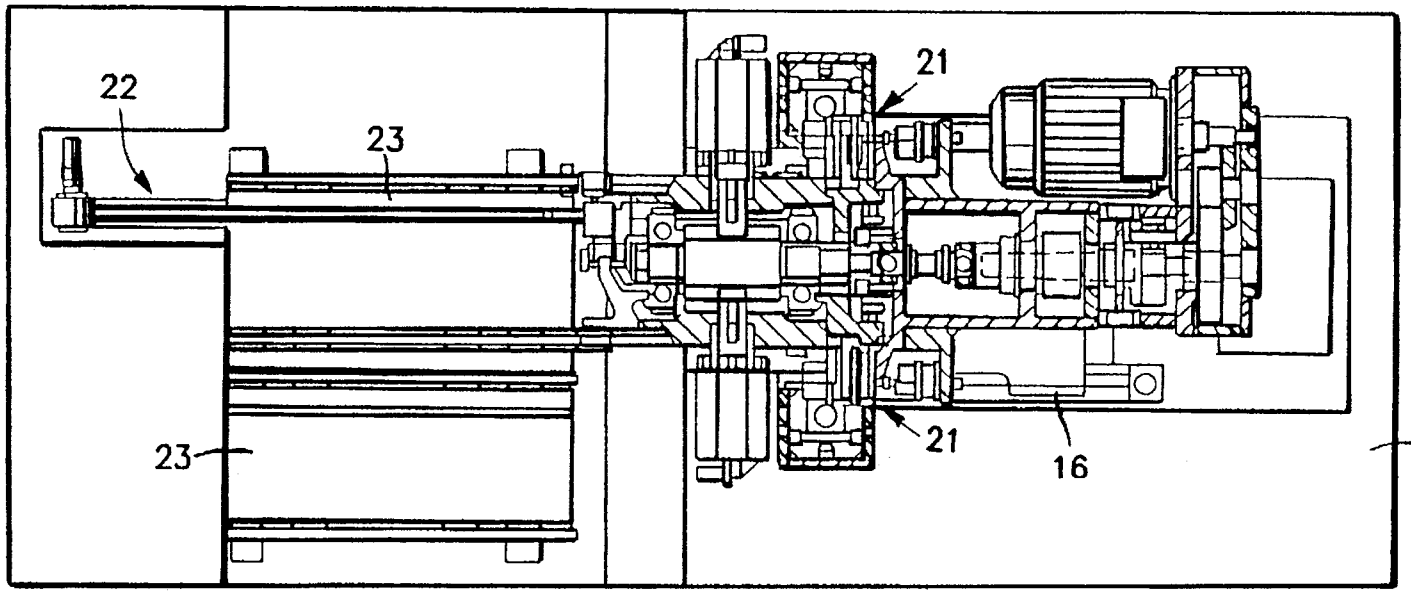

FIGS. 4 and 5 show the roll-pair unit illustrated in FIGS. 1–3 fitted to a supportive base structure 15 with the rolls in a horizontal position. In this case, the roll-pair unit is mounted displaceably on the supportive structure through the medium of outwardly projecting guide flanges 16 each mounted on a respective side of the pinion stand housing and extending laterally to the longitudinal axis of the roll-pair unit, said guide flanges 16 coacting with corresponding guides 17 on the supportive base structure. Mounted on the undersurface of the pinion stand housing beneath the centre of gravity of the roll-pair unit is an attachment flange 18 which has attached thereto one end of a rod 19 or the like which forms part of a displacement mechanism 20 mounted on the supportive base structure. The displacement mechanism 20 is preferably a rack-and-pinion or screw-nut type mechanism, although other types of displacement mechanisms are conceivable, such as hydraulic piston-cylinder type mechanisms. This arrangement enables the rolls 9, 10 to be displaced laterally in relation to the rolling line, by displacing the whole of the roll-pair unit by means of the displacement mechanism.

The roll-pair unit also includes a component fastening mechanism 21 which is mounted on the pinion stand housing 5 and which functions to fasten the cassette 2 to said housing, said mechanism being an eccentric type mechanism for instance, with which rotation of a cylindrical member will bring a surface, which is eccentric in relation to the rotational centre, into abutment with a complementary surface on the cassette and therewith press the cassette forcefully against an abutment surface on the pinion stand housing. Naturally, component fastening mechanisms other than an eccentric mechanism can be used.

In order to enable rolls to be exchanged, the cassette 2 is connected to a withdrawal device 22 of known construction when positioned out of engagement with the pinion stand housing 5, i.e. when the cassette is not gripped by the eccentric surface on the component fastening mechanism 21. The cassette, and therewith also the roll unit carried by the cassette, can be moved to the left in the FIGS. 4 and 5 by means of the withdrawal device 22, until the entire cassette rests on a carriage 23. The roll unit 1 can be lifted from the cassette with the aid of an overhead crane or the like and replaced with a new roll unit, or alternatively the carriage supporting the cassette and roll unit can be moved to one side laterally in relation to the longitudinal axis of the roll-pair unit and replaced with a new carriage carrying a replacement cassette.

Figure 6:
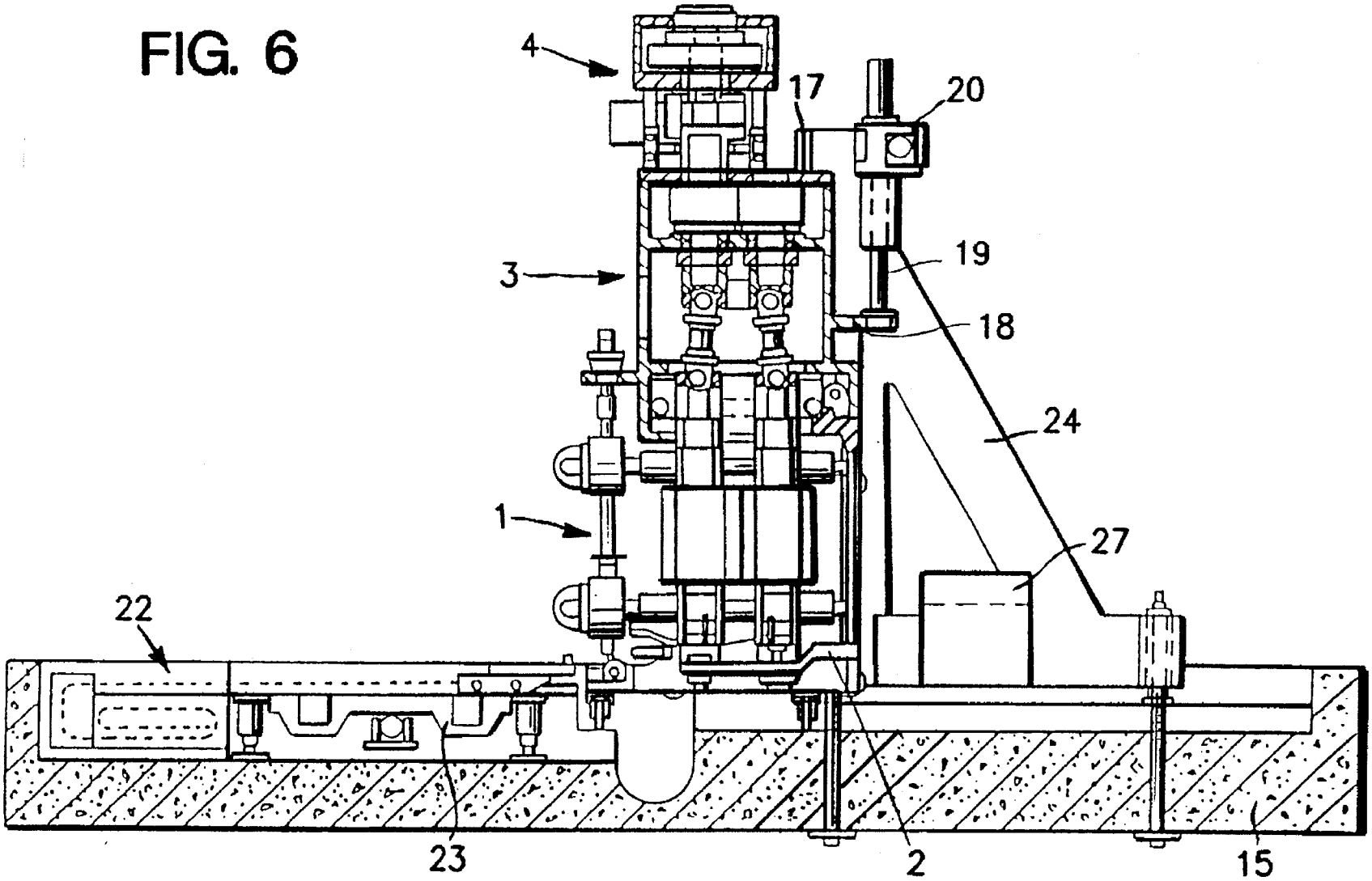
FIG. 6 is a vertical sectional view of a roll-pair unit according to FIG. 1 with the rolls arranged vertically.

FIG. 6 illustrates a roll-pair unit according to FIGS. 1–3 mounted on a supportive base structure 15 with the rolls extending vertically. In this case, the roll-pair unit is carried by a vertical frame structure 24 firmly mounted on the supportive base structure 15, this base structure being identical to the base structure illustrated in FIGS. 4 and 5. The frame structure 24 carries the rod or bar 19 which coacts with the attachment flange 18 on the pinion stand housing 5 and which can be moved by means of the displacement mechanism 20 in the manner described with reference to FIGS. 4 and 5. The frame structure 24 is also provided with guides 17 along which the pinion stand housing can slide. Similar to the supportive base structure illustrated in FIGS. 4 and 5, the supportive base structure 15 of the FIG. 6 embodiment includes a cassette withdrawal device 22 and carriages 23 for facilitating roll exchanges.

Figure 7:
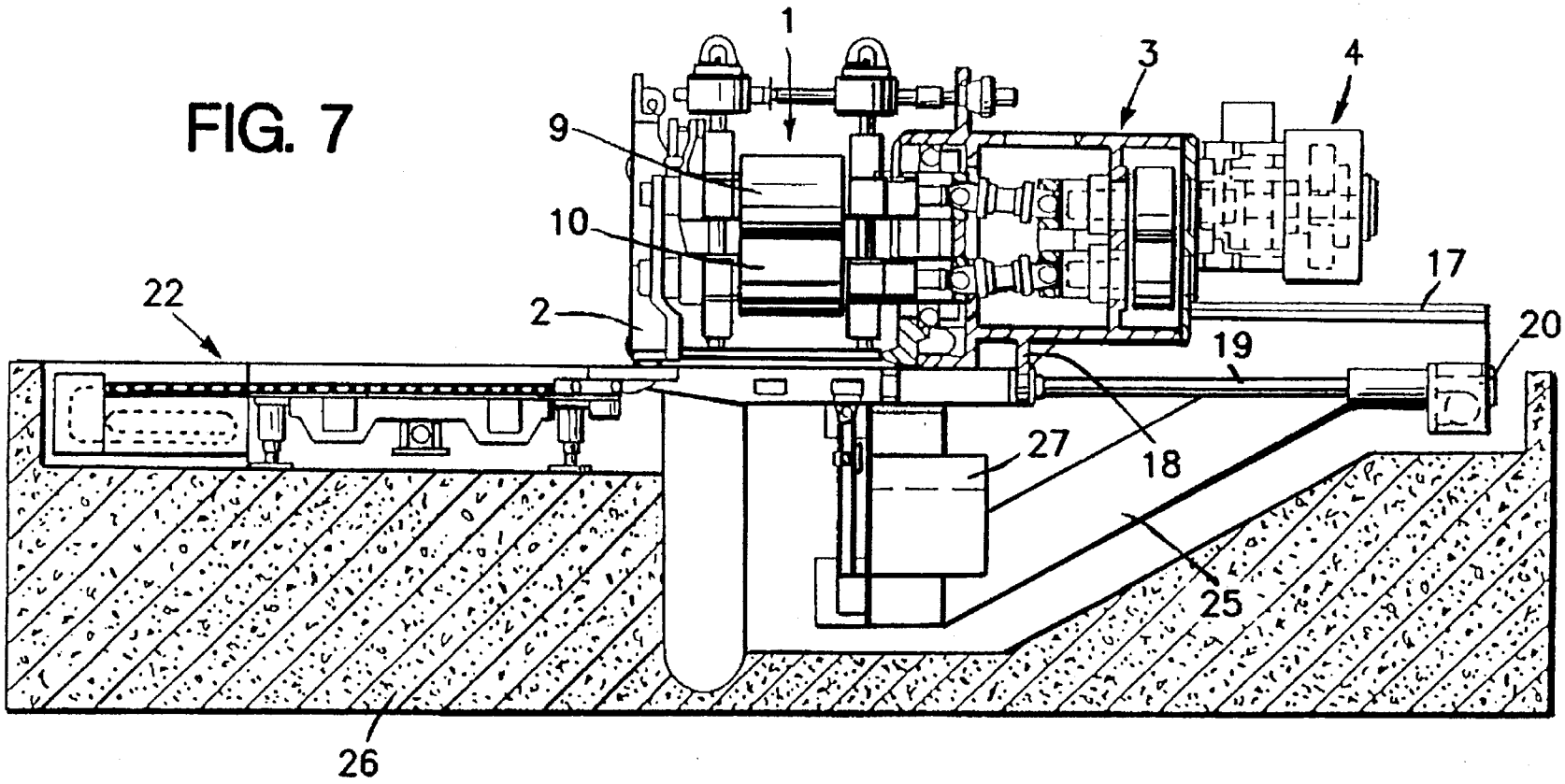
FIGS. 7 and 8 are respective sectional views of a convertible supported roll-pair unit according to FIG. 1 with the rolls in a horizontal and a vertical position respectively.
Figure 8:
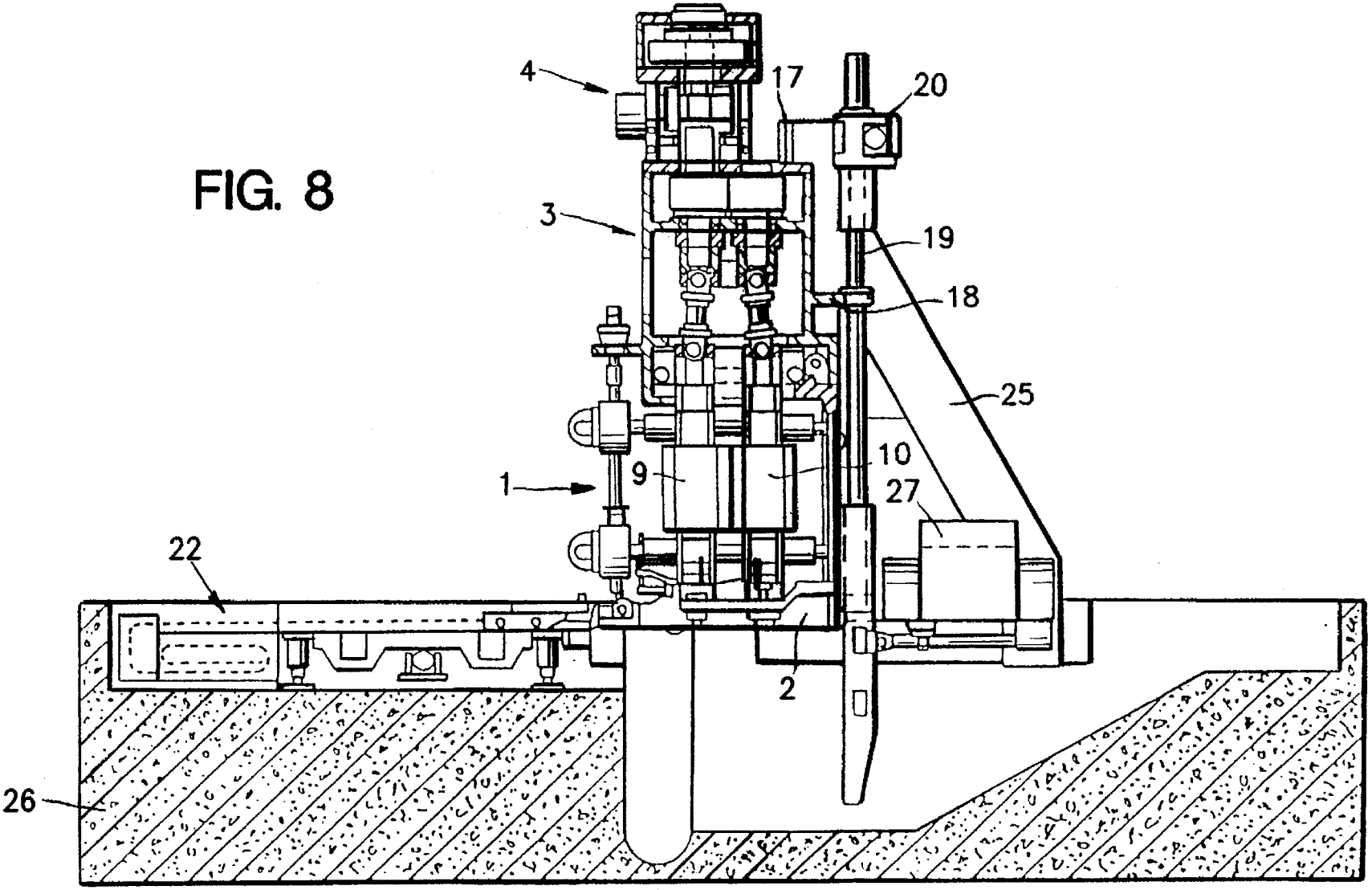

FIGS. 7 and 8 illustrate a variant of the invention in which the roll-pair unit is carried by a frame structure 25 which is pivotally mounted on a supportive base structure 26 for pivotal movement between a first position in which the shafts of rolls 9, 10 of one roll-pair unit carried by the frame structure extend horizontally, and a second position in which the shafts of the rolls 9, 10 extend vertically.

The frame structure 25 is pivotally mounted on the supportive base structure 26 by means of two shaft-ends which are firmly connected to the frame structure and project out opposite one another on opposite sides of the frame structure and each of which extends through a respective bearing box. A lever arm is fitted to at least one of the shaft-ends projecting out from respective bearing boxes and a suitable jack or ram means, for instance a hydraulic piston-cylinder device, is pivotally mounted to the free end of said at least one shaft-end. The other end of this jack, or ram, is pivotally mounted on the supportive base structure 26.

When swinging the frame structure 25 from the position illustrated in FIG. 7, in which the roll shafts extend horizontally, to the position shown in FIG. 8, in which the roll shafts extend vertically, the roll-pair unit is conveniently moved to the right in FIG. 7, by means of the displacement mechanism 19, 20, at the speed at which the frame structure is swung upwards by means of the jack or ram means. In this way, when setting-up the roll-pair unit and frame structure, the centre of gravity will lie close to the pivot axis during the whole of the pivoting sequence, which is favourable from a loading aspect.

As indicated schematically with the lubricant container 27 in FIGS. 4–8, the supportive base structures 15 and 26 each incorporate a lubricating system which functions to lubricate and cool the rotating parts of the roll-pair unit. The lubricant container 27 has a relatively large volumetric capacity, in the order of 500 l, so as to enable degasification and cooling of the recycled lubricant, oil. Although the lubricant containers 27 are shown in the Figures to be carried by the supportive base structure, it will be understood that these containers, together with other lubricating system components, such as pumps, couplings and conduits, can be carried by the pinion stand housing.

Because remaining components of the roll-pair unit are carried by the pinion stand housing, the roll-pair unit can be assembled by the supplier and then fitted into the rolling mill line in the form of a unit. This enables the roll-pair units forming part of a rolling mill line to be fitted, or mounted, very quickly. Since the pinion stand housing is secured to the supportive base structure in a very simple manner, the task of fitting the pinion stand housing to the base structure can be quickly achieved without the assistance of qualified personnel. Furthermore, the roll-pair units can be used with the rolls extending horizontally or vertically without change, which naturally reduces the need of replacement roll-pairs, since only one type of unit need be kept in storage. Even when not using a roll-pair unit which is supported convertably on a supportive base structure, the construction of a new rolling mill line for a new product can be simplified in many cases by using the same roll-pair unit as that used in the old rolling mill line with the roll shafts extending in another direction. Since the roll-pair unit can be lifted in its entirety in accordance with the present invention, a change in the direction in which the roll shafts extend can be easily achieved. Furthermore, the invention results in a decrease in the number of components in the roll-pair unit drive arrangement in comparison with known roll-pair units, meaning that the number of movable parts which must be enclosed and maintained is fewer than in the case of the earlier known technique.

Because the inventive drive arrangement is very short, due to the positioning of the alternating current motor and the use of planetary gearing, a rolling line comprised of roll-pair units which include such drive arrangements will occupy only a small space in comparison with a rolling line that is comprised of roll-pair units which include conventional drive arrangements, therewith enabling a reduction in the height and breadth dimensions of the rolling mill.

It will be understood that the described drive arrangement can be modified in different ways within the scope of the present invention. For instance, in addition to transmitting the motor drive torque to the planetary gearing, the gear transmission can also be given a down-stepping function or even an up-stepping function, so as to form a roll-pair unit reduction gear together with the planetary gearing. It is also possible to achieve a given degree of standardization, by using similar planetary gearing at different locations in the rolling mill line, owing to the fact that the necessary differences in transmission ratios can be achieved with the aid of different gears. The invention is therefore limited solely by the content of the following claims.

We claim:

1. In combination with a roll-pair having synchronously driven shafts, a drive arrangement for said roll-pair, said drive arrangement comprising an alternating current motor (12) and a planetary gear mechanism (13), the alternating current motor (12) and the planetary gear mechanism (13) being disposed in side-by-side relationship, the alternating current motor (12) having an output shaft and the planetary gear mechanism (13) having an input shaft, and a transmission (14) interconnecting said output shaft and said input shaft, said roll-pair and said alternating current motor (12) and said planetary gear mechanism (13) all being disposed on the same side of said transmission (14).

2. The structure claimed in claim 1, wherein the transmission (14) is a gear transmission.

3. The structure claimed in claim 1, said input and output shafts being parallel to each other.

* * * * *